US008056151B2

(12) United States Patent
Bologna et al.

(10) Patent No.: US 8,056,151 B2
(45) Date of Patent: Nov. 15, 2011

(54) BUCKLE FOR A CHIN STRAP ASSEMBLY FOR A SPORTS HELMET

(75) Inventors: Vittorio Bologna, Elk Grove Village, IL (US); Thad M. Ide, Chicago, IL (US); Nelson Kraemer, Mount Prospect, IL (US)

(73) Assignee: Riddell, Inc., Rosemont, IL (US)

( * ) Notice: Subject to any disclaimer, the term of this patent is extended or adjusted under 35 U.S.C. 154(b) by 63 days.

(21) Appl. No.: 12/589,114

(22) Filed: Oct. 15, 2009

(65) Prior Publication Data

US 2010/0192286 A1 Aug. 5, 2010

Related U.S. Application Data

(60) Provisional application No. 61/196,126, filed on Oct. 15, 2008.

(51) Int. Cl.
*A42B 7/00* (2006.01)

(52) U.S. Cl. ..... 2/421; 24/324

(58) Field of Classification Search ..... 2/205, 417, 2/421, 425; 24/309, 323, 324, 458
See application file for complete search history.

(56) References Cited

U.S. PATENT DOCUMENTS

| | | | | |
|---|---|---|---|---|
| 1,262,818 | A | 4/1918 | McGill | |
| 2,051,715 | A * | 8/1936 | Johnson | 24/324 |
| 2,140,716 | A | 12/1938 | Pryale | |
| 2,250,275 | A | 7/1941 | Riddell | |
| 2,867,811 | A | 1/1959 | Jones | |
| 3,166,761 | A | 1/1965 | Elwood | |
| 3,186,004 | A | 6/1965 | Carlini | |
| 3,187,342 | A | 6/1965 | Aileo | |
| 3,237,257 | A * | 3/1966 | Forsberg | 24/324 |
| 3,619,813 | A | 11/1971 | Marchello | |
| 3,761,959 | A | 10/1973 | Dunning | |
| 3,787,895 | A | 1/1974 | Belvedere | |
| 3,916,446 | A | 11/1975 | Gooding | |
| 4,044,400 | A | 8/1977 | Lewicki | |
| 4,075,714 | A | 2/1978 | Ryder et al. | |
| 4,461,044 | A | 7/1984 | Reiterman | |
| 4,646,368 | A | 3/1987 | Infusino et al. | |
| 4,651,356 | A | 3/1987 | Zide | |
| 4,692,947 | A | 9/1987 | Black et al. | |
| 4,741,054 | A | 5/1988 | Mattes | |
| 4,774,729 | A | 10/1988 | Coates et al. | |
| D301,566 | S * | 6/1989 | Heiberger | D11/218 |

(Continued)

OTHER PUBLICATIONS

Riddell® 2008, Multi-Sport catalog, including cover page and football chin straps (p. 14).

(Continued)

*Primary Examiner* — Gary L Welch
*Assistant Examiner* — Andrew W Collins
(74) *Attorney, Agent, or Firm* — McDermott Will & Emery LLP

(57) ABSTRACT

A chin strap assembly for a protective sports helmet features a buckle that comprises a body portion, an attachment portion, a first side rail, and a second side rail. The body portion has a first strap opening and a second strap opening formed therethrough. The body portion has a first end segment and a second end segment. The attachment portion is adapted to interact with a fastener on the helmet. The first and second side rails are opposed and extend between the first and second end segments, and have a generally arcuate shape. First and second lateral holes are positioned internal to the first and second side rails.

19 Claims, 3 Drawing Sheets

U.S. PATENT DOCUMENTS

| | | | |
|---|---|---|---|
| 4,837,866 | A | 6/1989 | Rector et al. |
| 4,853,980 | A | 8/1989 | Zarotti |
| 4,903,346 | A | 2/1990 | Reddemann et al. |
| 4,916,759 | A | 4/1990 | Arai |
| 4,947,490 | A | 8/1990 | Hayden |
| 5,177,816 | A | 1/1993 | Schmidt et al. |
| 5,267,353 | A | 12/1993 | Milligan |
| 5,293,649 | A | 3/1994 | Corpus |
| 5,347,660 | A | 9/1994 | Zide et al. |
| 5,732,414 | A | 3/1998 | Monica |
| 5,794,274 | A | 8/1998 | Kraemer |
| 5,963,990 | A | 10/1999 | White |
| 6,079,053 | A | 6/2000 | Clover et al. |
| 6,081,932 | A | 7/2000 | Kraemer |
| 6,189,156 | B1 | 2/2001 | Loiars |
| 6,481,024 | B1 | 11/2002 | Grant |
| 6,934,971 | B2 | 8/2005 | Ide et al. |
| 7,146,652 | B2 | 12/2006 | Ide et al. |
| 2002/0148081 | A1 * | 10/2002 | Ide et al. ..... 24/324 |

OTHER PUBLICATIONS

Schutt™ 2008 football catalog, (p. 28).

* cited by examiner

BUCKLE FOR A CHIN STRAP ASSEMBLY FOR A SPORTS HELMET

CROSS-REFERENCE TO RELATED APPLICATIONS

This application claims priority from and the benefit of U.S. Provisional Application No. 61/196,126, filed Oct. 15, 2008, which is incorporated herein by reference and made a part hereof.

FEDERALLY SPONSORED RESEARCH OR DEVELOPMENT

N/A

TECHNICAL FIELD

The invention relates to a buckle for a chin strap for a protective helmet, namely for contact sports. The buckle includes first and second side rails that offer greater structural rigidity to resist bending and flattening of the buckle over time.

BACKGROUND OF THE INVENTION

Helmets for contact sports, such as those used in football, hockey and lacrosse, typically include a shell, a faceguard or face mask, and a chin protector or strap that removably secures the helmet on the wearer's head. The chin strap typically contains a plurality of buckles that interact with fasteners, such as snaps, affixed to the shell. The buckles and snaps allow the chin strap to be easily disengaged from the helmet to allow the user to remove the helmet.

One existing buckle 10, as shown in FIG. 1, has a body portion 12 with a first opening 14 and a second opening 16 formed therethrough to allow the chin strap to pass through the buckle 10. A plurality of teeth 15 are located proximate each opening 14, 16 engage an extent of the chin strap. The buckle 10 further has a female snap portion 18 adapted to interact with a male snap portion on the shell to removably fasten the chin strap to the helmet. The body portion 12 is generally formed from a metal sheet and has a generally convex shape when the buckle 10 is new. However, over time, the buckle 10 tends to flatten based on the forces required to attach the buckle 10 to the snaps on the helmet, or from the buckle 10 being repeatedly contacted during play. As it flattens, the life of the buckle 10 is reduced.

Thus, the need exists for a buckle for a chin strap that resists bending over time to increase the life of the buckle.

SUMMARY OF THE INVENTION

According to one embodiment, a buckle for protective sports helmet chin strap comprises a body portion, an attachment portion, a first side rail, and a second side rail. The body portion has a first strap opening and a second strap opening formed therethrough. The body portion has a first end and a second end. The attachment portion is adapted to interact with a fastener on the helmet. The first rail extends between the first end to the second end of the body portion, and has a generally arcuate shape. The second rail runs from the first end to the second end of the body portion, and has a generally arcuate shape. The second rail is positioned on an opposite side of the body portion as the first rail.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
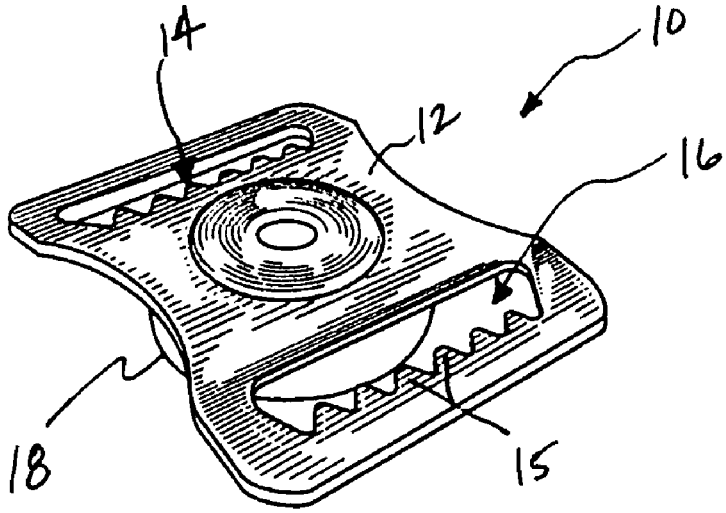
FIG. 1 Prior Art
FIG. 1 is a perspective view of a prior art chin strap buckle.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
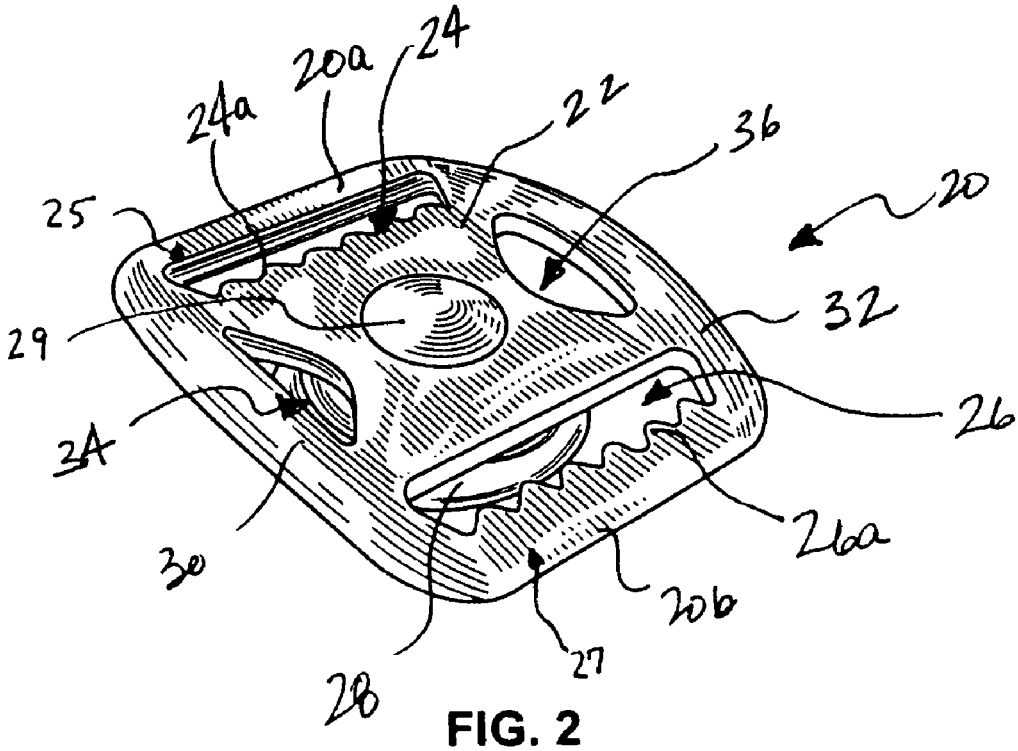
FIG. 2 is a perspective view of a chin strap buckle of the invention.
Figure 3:
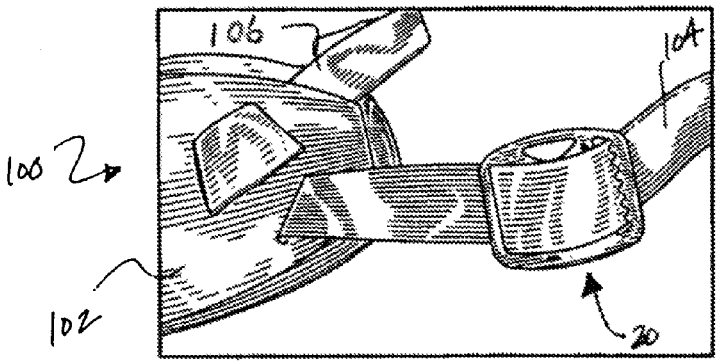
FIG. 3 is a pictorial view of the chin strap buckle of FIG. 2 incorporated with a chin strap assembly and a helmet.
Figure 4:
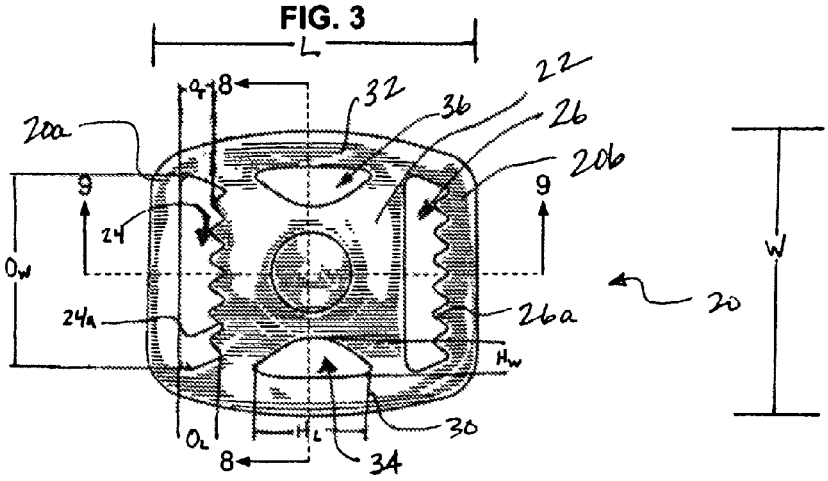
FIG. 4 is a top view of the chin strap buckle of FIG. 2.

FIGS. 2-9 show a chin strap buckle 20 of the invention that is connectable to a chin strap assembly, which is used to secure a sports helmet to a player's head. The chin strap buckle 20 comprises a central body portion 22 having a first strap opening 24 and a second strap opening 26 formed therein. As a result of the first and second opening 24, 26, the body portion 22 has a first end segment 25 and a second end segment 27. The first strap opening 24 and the second strap opening 26 further have strap securing portions 24*a*, 26*a*, respectively, formed within the strap openings 24, 26. Referring to FIGS. 2 and 3 the strap securing portions 24*a*, 26*a* include a plurality of teeth that engage an extent of chin strap 104 to help secure the buckle 20 in a fixed location relative to a chin strap 104. The first strap opening 24 and the second strap opening 26 preferably have an overall width $O_W$ of 14 to 17 millimeters, and most preferably an overall width $O_W$ of 15.5 millimeters. Also, the first and second strap openings 24, 26 preferably have an overall length $O_L$ of 2.5 to 4 millimeters, and most preferably an overall length $O_L$ of 3.33 millimeters. Similarly, the space between the tips of the teeth and the opposing flat edge $O_T$ is preferably 2 to 2.5 millimeters, and most preferably is 2.28 millimeters.

Figure 5:
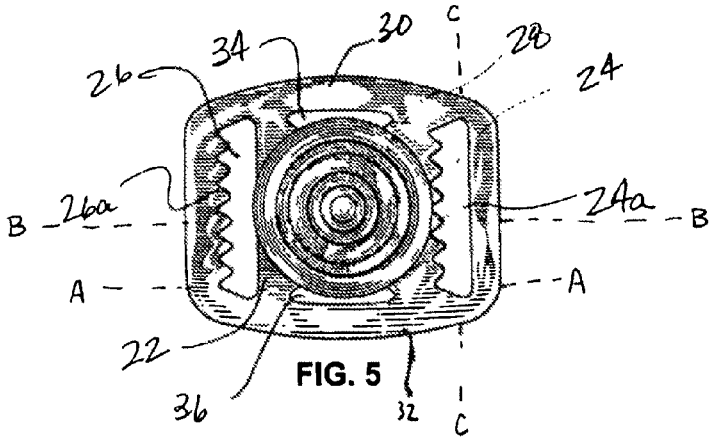
FIG. 5 is a bottom view of the chin strap buckle of FIG. 2.

As may be best observed in FIG. 5, an attachment portion 28 is provided on buckle 20, to fasten the chin strap assembly 100 (FIG. 3) to a helmet. The attachment portion 28 includes a central rivet 29. The attachment portion 28 shown is the female component of a snap assembly, however, the attachment portion 28 may be the male component of a snap assembly. It is contemplated that other known attachment types may also be utilized. Based upon its various structures, the buckle 20, including the attachment portion 28, has a snap-on force between twenty and thirty-five pounds when the attachment portion 28 engages the male attachment component connected to the helmet. Following the attachment of the chin strap buckle 20 to a helmet, the attachment portion 28 has a snap-off force of between five and ten pounds of force when disengaging the chin strap buckle 20 from the male component connected to the helmet.

As shown in FIG. 3, the chin strap buckle 20 is adapted to be utilized with a chin strap assembly 100. The chin strap assembly 100 is used in connection with a protective helmet, such as a football, hockey, lacrosse, or military helmet to help keep the helmet properly positioned on a wearer's head, as well as offering protection to the users chin. The chin strap assembly 100 includes a chin cup member 102, a first strap 104, a second strap 106, and at least one chin strap buckle 20. The first strap 104 passes through the first and second openings 24, 26 (FIG. 2) of the buckle 20. The strap securing portions 24*a*, 26*a* help maintain the position of the buckle 20 along the strap 104, as the teeth of the strap securing portions 24*a*, 26*a* engage the strap 104 to resist movement of the buckle 20 relative to the strap 104.

Figure 7:
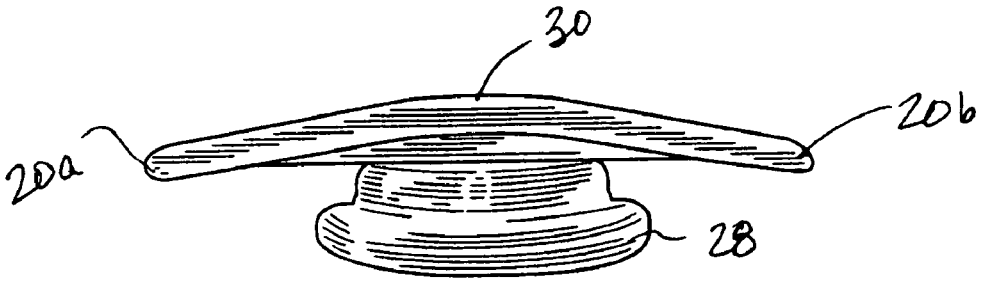
FIG. 7 is a side view of the chin strap buckle of FIG. 2.
Figure 9:
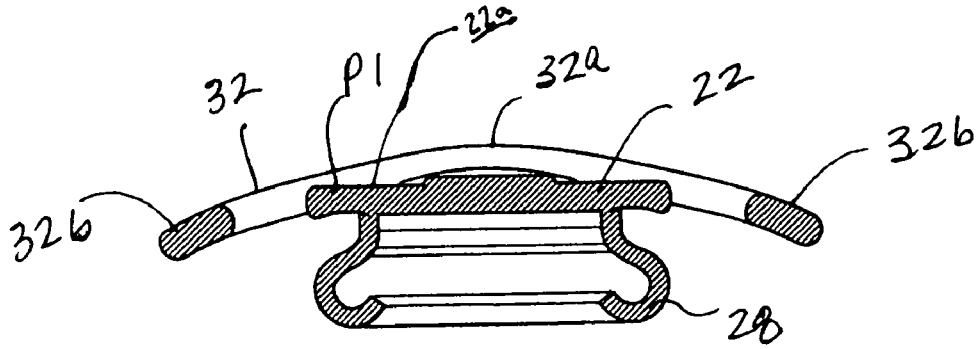
FIG. 9 is a cross-sectional view taken along line 9-9 of FIG. 4.

A first side rail 30 and a second side rail 32 extend longitudinally between a first end 20*a* to a second end 20*b* of the buckle 20 and along the periphery of the buckle 20. The first and second rails 30, 32 and the first and second end segments 25, 27 define the periphery of the buckle 20. The first and second side rails 30, 32 have a thickness of 1.0 to 1.5 mm, and preferably 1.25 to 1.30 mm. The first rail 30 and the second rail 32 generally have a convex arcuate shape, as best seen in FIGS. 7 and 9. That is, the height of the first rail 30 and the second rail 32 is generally greater at a center of the buckle 20 than at the first and second ends 20*a*, 20*b* of the buckle 20. As shown in FIG. 9, the central portion 32*a* of the second rail 32 (the first rail 30 is generally a mirrored version of the second rail 32) protrudes to a height above the central body portion 22 and the terminal rail ends 30*a*, 32*b* depend below the body portion 22. The upper surface 22*a* of the body portion 22 defines a substantially horizontal plane P1, wherein the central rail portion 32*a* resides above the horizontal plane P1 and terminal ends 32*b* reside below the plane P1. Thus, when a strap, such as the strap 104 in FIG. 3, is inserted into the buckle 20, the central portion 30*a*, 32*a* of the first and second rails 30, 32 extend to an elevation that is generally higher than the strap. Such an arrangement may assist a user when unbuckling the strap from the helmet, as the user can grasp the buckle 20, due the rails 30, 32 protruding above the strap.

Figure 6:
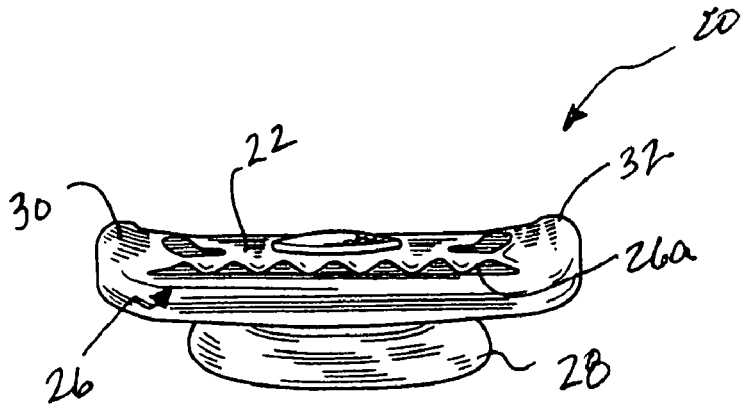
FIG. 6 is a front view of the chin strap buckle of FIG. 2.
Figure 8:
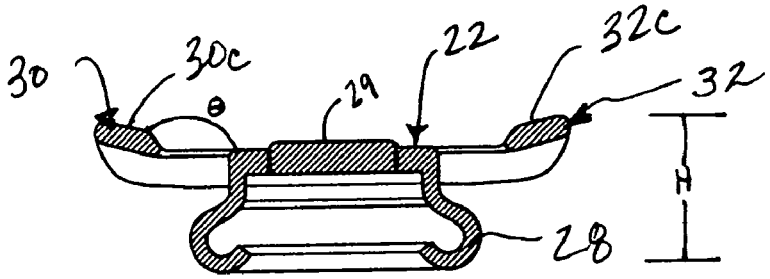
FIG. 8 is a cross-sectional view taken along line 8-8 of FIG. 4.

In addition to having a generally convex arcuate shape along a longitudinal axis of the buckle 20, the first rail 30 and the second rail 32 are generally inclined in a transverse direction, having a lower elevation at the inner portion of the rails 30, 32 (nearer the rivet 29), and a higher elevation at the outer portion of the rails 30, 32, as shown in FIGS. 6 and 8. Thus, the upper surface 30*c*, 32*c* of the rails 30, 32 is inclined or sloped from the inner periphery to the outer periphery of the rail 30, 32. Preferably, the upper surfaces 30*c*, 32*c* of the rails 30, 32 form an obtuse angle θ in relation to the body portion 22 of the buckle, wherein θ is 150 to 170 degrees, and preferably 165 degrees.

The generally convex arcuate shape of the rails 30, 32 helps resist bending of the buckle 20 along the transverse axis that may result in flattening of the buckle 20. The presence of the rails 30, 32, along with the arcuate geometry of the rails 30, 32, imparts much greater structural strength to the buckle 20 compared to prior buckles. Further, the buckle 20 may be utilized for a longer period of time without being replaced if it retains its original shape, thus reducing the cost associated with frequently replacing the buckle 20. In addition to resisting the flattening of the buckle 20 about the transverse axis, the incline of the first rail 30 and the second rail 32 also helps the buckle 20 resist bending of the rails 30, 32 about the longitudinal axis. Thus, prior to the buckle 20 bending, forces applied to the buckle 20 would need to be sufficient to flatten the rails 30, 32 about the longitudinal axis, thus removing the incline of the rails 30, 32, and the forces would further have to be sufficient to cause bending about the transverse axis to remove the convex arcuate shape of the rails 30, 32.

In one embodiment, a first lateral hole 34 and a second lateral hole 36 are formed between the body portion 22 and the rails 30, 32. The first and second lateral holes 34, 36 reduce the weight of the buckle 20 by removing material. The first and second lateral holes 34, 36 have an substantially linear outer edge and a curvilinear inner edge. The first and second lateral holes 34, 36 have an approximate width $H_W$ that may be between 2.5 to 4.5 millimeters, and is most preferably 3.5 millimeters. Similarly, the first and second lateral through holes 34, 36 have a length $H_L$ that may be between 8 to 14 millimeters, and is most preferably 10 millimeters. Referring to FIG. 5, the first and second lateral holes 34, 36 have a longitudinal axis A-A that is substantially parallel to longitudinal axis B-B of the buckle 20 and that is substantially perpendicular to longitudinal axis C-C of strap openings 24, 26.

The chin strap buckle 20 preferably has an overall length L, which is the distance between the first and second ends 20*a*, 20*b*, of 24 to 28 millimeters, and most preferably an overall length L of 26 millimeters. The chin strap buckle 20 preferably has a overall width W, which is the distance from the outermost point of the first rail 30 to the outermost point of the second rail 32, of 20 to 24 millimeters, and most preferably an overall width W of 22 millimeters. Further, the chin strap buckle 20 preferably has an overall height H of 7.75 to 8.15 millimeters, and most preferably an overall height H of 8.05 millimeters.

It is contemplated that a number of materials, including plastic or metallic materials, may be utilized for manufacturing the buckle 20. For example, the body portion 22 and the attachment portion 28 would be manufactured from stainless steel, preferably 302 stainless steel. It is further contemplated that the attachment portion 28 and the body portion 22 may comprise different materials, such as stainless steel being utilized on the body portion 22 and plastic being used for at least a portion of the attachment portion 28. It is further contemplated that brass may be used in place of the stainless steel materials as described above.

While the specific embodiments have been illustrated and described, numerous modifications come to mind without significantly departing from the spirit of the invention, and the scope of protection is only limited by the scope of the accompanying claims.

We claim:

1. A chin strap assembly for a protective helmet chin strap comprising:

a buckle connectable to a strap of the chin strap assembly, the buckle comprising:

a body portion having a first strap opening and a second strap opening formed therethrough, the body portion having a first end and a second end;

an attachment portion adapted to interact with a fastener on the helmet to secure the buckle to the helmet;

a first convex rail extending from the first end to the second end of the body portion; and a second convex rail extending from the first end to the second end of the body portion, the second rail being positioned on an opposite side of the body portion as the first rail;

wherein the first and second rails are inclined in a transverse direction with a lower elevation at an inner periphery of the rails and a higher elevation at an outer periphery of the rails.

2. The chin strap assembly of claim 1, further comprising:

a first lateral hole in the body portion; and a second lateral hole in the body portion, wherein the first lateral hole is positioned between a center portion of the body portion and the first rail and the second lateral hole is positioned between the center portion of the body portion and the second rail.

3. The chin strap assembly of claim 1, wherein the first strap opening includes a first strap securing portion, and the second strap opening includes a second strap securing portion, the first and second strap securing portions engaging the strap.

4. The chin strap assembly of claim 1, wherein a central portion of the first and second rails protrudes above the body portion.

5. The chin strap assembly of claim 4, wherein terminal ends of the first and second rails extend below the body portion.

6. The chin strap assembly of claim 1, wherein an upper surface of the body portion defines a substantially horizontal plane, and wherein the central portion of the first and second rails resides above the horizontal plane.

7. The chin strap assembly of claim 6, wherein terminal ends of the first and second rails reside below the horizontal plane.

8. The chin strap assembly of claim 1, wherein the first and second rails and the first and second end segments collectively define the periphery of the buckle.

9. The chin strap assembly of claim 1, wherein the body portion, the first rail, and the second rail are formed from stainless steel.

10. A chin strap assembly for a protective helmet comprising:

a protective chin member adapted for placement over the chin of the wearer of the helmet;

at least one strap, the strap interacting with the chin cup member; and at least one buckle connectable the strap, the buckle having:

a body portion having a first strap opening and a second strap opening that form a first end segment and a second end segment;

an attachment portion, the attachment portion adapted to interact with a fastener on the helmet to connect the chin strap assembly to the helmet;

a first arcuate side rail extending from the first end segment to the second end segment of the body portion;

a second arcuate side rail extending from the first end segment to the second end segment of the body portion, wherein the first and second rails and the first and second end segments collectively define the periphery of the buckle; and wherein each of the first and second rails are inclined with respect to the body portion to form an obtuse angle.

11. The chin strap assembly of claim 10, wherein the first and second rails have a convex configuration whereby a central portion of the first and second rails extend above the body portion.

12. The chin strap assembly of claim 11, wherein terminal ends of the first and second rails extend below the body portion.

13. The chin strap assembly of claim 10, wherein an upper surface of the body portion defines a substantially horizontal plane, and wherein the central portion of the first and second rails resides above the horizontal plane.

14. The chin strap assembly of claim 13, wherein terminal ends of the first and second rails reside below the horizontal plane.

15. The chin strap assembly of claim 10, wherein the first and second side rails have a thickness of 1.0 to 1.5 mm.

16. The chin strap assembly of claim 10, wherein the obtuse angle is between 150 and 170 degrees.

17. The chin strap assembly of claim 16, wherein the obtuse angle is 165 degrees.

18. A chin strap assembly for a protective helmet comprising:

a strap; and at least one buckle connectable the strap, the buckle having:

a body portion having a first strap opening and a second strap opening that form a first end segment and a second end segment;

an attachment portion, the attachment portion adapted to interact with a fastener on the helmet to connect the chin strap assembly to the helmet;

a first arcuate side rail extending from the first end segment to the second end segment of the body portion;

a second arcuate side rail extending from the first end segment to the second end segment of the body portion, wherein the first and second rails and the first and second end segments collectively define the periphery of the buckle; and wherein the first and second rails have a convex configuration whereby a central portion of the first and second rails extend above the body portion and terminal ends of the first and second rails extend below the body portion.

19. The chin strap assembly of claim 18, wherein each of the first and second rails are inclined with respect to the body portion to form an obtuse angle.

* * * * *